US012435573B2

(12) United States Patent
Hutton

(10) Patent No.: US 12,435,573 B2
(45) Date of Patent: Oct. 7, 2025

(54) PUSH THE BIT ROTARY STEERABLE SYSTEM

(71) Applicant: D-TECH (UK) LTD, Bristol (GB)

(72) Inventor: Richard Hutton, Bristol (GB)

(73) Assignee: D-Tech (UK) Ltd, Bristol (GB)

( * ) Notice: Subject to any disclaimer, the term of this patent is extended or adjusted under 35 U.S.C. 154(b) by 0 days.

(21) Appl. No.: 18/915,084

(22) Filed: Oct. 14, 2024

(65) Prior Publication Data

US 2025/0215749 A1 Jul. 3, 2025

Related U.S. Application Data

(63) Continuation of application No. 18/303,753, filed on Apr. 20, 2023, now Pat. No. 12,116,894, which is a continuation of application No. 17/341,109, filed on Jun. 7, 2021, now Pat. No. 11,649,680, which is a continuation of application No. 15/999,107, filed as application No. PCT/IB2017/000233 on Feb. 20, (Continued)

(51) Int. Cl.

| | |
|---|---|
| ***E21B 7/06*** | (2006.01) |
| ***E21B 3/00*** | (2006.01) |
| ***E21B 47/022*** | (2012.01) |
| *E21B 47/024* | (2006.01) |

(52) U.S. Cl.

CPC ..... *E21B 7/067* (2013.01); *E21B 3/00* (2013.01); *E21B 7/06* (2013.01); *E21B 7/062* (2013.01); *E21B 47/022* (2013.01); *E21B 47/024* (2013.01)

(58) Field of Classification Search

CPC ..... E21B 7/06; E21B 34/10

See application file for complete search history.

(56) References Cited

U.S. PATENT DOCUMENTS

| | | | |
|---|---|---|---|
| 3,554,302 | A | 1/1971 | Adkins |
| 4,241,796 | A | 12/1980 | Green |

(Continued)

FOREIGN PATENT DOCUMENTS

| | | |
|---|---|---|
| CA | 949550 | 6/1974 |
| CA | 2810266 | 5/2016 |

(Continued)

OTHER PUBLICATIONS

International Search Report and Written Opinion Issued in Corresponding PCT Patent Application No. PCT/IB2017/000233, mailed Aug. 1, 2017.

(Continued)

*Primary Examiner* — Shane Bomar

(74) *Attorney, Agent, or Firm* — Norton Rose Fulbright US LLP

(57) ABSTRACT

A method, device, and system is described herein for pushing a rotary drill bit. Pushing the rotary drill bit can include receiving a target direction in a formation to push the rotary drill bit while drilling a wellbore in a formation. Pushing the rotary drill bit can also include opening, at a first rotational position of a rotary bit pushing device disposed proximate to the rotary drill bit within the wellbore, a first inlet port of a first flow regulator. Pushing the rotary drill bit can further include closing, after the first rotational position of the rotary bit pushing device, the first inlet port. Pushing the rotary drill bit can also include sending, to a second flow regulator of the rotary bit pushing device, a second quantity of drilling fluid.

11 Claims, 11 Drawing Sheets

Related U.S. Application Data

2017, now Pat. No. 11,028,645, which is a continuation of application No. 15/046,963, filed on Feb. 18, 2016, now Pat. No. 9,624,727.

(56) References Cited

U.S. PATENT DOCUMENTS

| | | | | |
|---|---|---|---|---|
| 5,706,905 | A | 1/1998 | Barr | |
| 6,116,355 | A | 9/2000 | Thorp et al. | |
| 6,257,356 | B1 | 7/2001 | Wassell | |
| 8,474,552 | B2 | 7/2013 | de Paula Neves | |
| 9,121,223 | B2 | 9/2015 | Niina et al. | |
| 9,243,454 | B2 | 1/2016 | Wenzel | |
| 9,624,727 | B1 | 4/2017 | Hutton | |
| 10,422,184 | B1 | 9/2019 | Feddema et al. | |
| 11,028,645 | B2 | 6/2021 | Hutton | |
| 11,174,682 | B2 | 11/2021 | Doud et al. | |
| 11,396,774 | B2 | 7/2022 | Chambers et al. | |
| 2008/0000693 | A1 | 1/2008 | Hutton | |
| 2008/0053707 | A1 | 3/2008 | Martinez | |
| 2010/0025116 | A1 | 2/2010 | Hutton | |
| 2011/0120775 | A1* | 5/2011 | Krueger | E21B 7/068 175/73 |
| 2012/0160564 | A1 | 6/2012 | Downton et al. | |
| 2013/0075164 | A1 | 3/2013 | Hutton et al. | |
| 2013/0118812 | A1 | 5/2013 | Clausen et al. | |
| 2014/0014413 | A1 | 1/2014 | Niina | |
| 2014/0097026 | A1 | 4/2014 | Clark | |
| 2014/0110178 | A1 | 4/2014 | Savage et al. | |
| 2015/0129316 | A1 | 5/2015 | Harrington et al. | |
| 2016/0002978 | A1 | 1/2016 | Rushton | |
| 2019/0128071 | A1* | 5/2019 | Conger | E21B 34/06 |
| 2019/0352558 | A1 | 11/2019 | Tilley | |
| 2020/0199970 | A1* | 6/2020 | Odegbami | E21B 7/064 |
| 2020/0308928 | A1* | 10/2020 | Chambers | E21B 7/068 |
| 2021/0079729 | A1* | 3/2021 | Wheeler | E21B 7/064 |
| 2021/0285290 | A1* | 9/2021 | D'Silva | E21B 7/062 |
| 2022/0025709 | A1 | 1/2022 | Hutton | |
| 2022/0282574 | A1 | 9/2022 | Bedouet | |
| 2023/0021983 | A1 | 1/2023 | Hutton | |
| 2023/0042012 | A1 | 2/2023 | Hutton | |
| 2025/0084704 | A1* | 3/2025 | Bedouet | E21B 17/1078 |

FOREIGN PATENT DOCUMENTS

| | | |
|---|---|---|
| CN | 101454532 | 6/2009 |
| CN | 104395548 | 3/2015 |
| CN | 105239924 | 1/2016 |
| EP | 3417140 | 6/2020 |
| RU | 2009304 | 3/1994 |
| RU | 1779088 | 4/1994 |
| RU | 94024952 | 6/1996 |
| WO | WO 2012/031353 | 3/2012 |
| WO | WO 2017/141115 | 8/2017 |

OTHER PUBLICATIONS

Office Action and Search Report Issued in Corresponding Chinese Patent Application No. 201780018334.3, dated Nov. 26, 2019.

Office Action issued in Corresponding Canadian Application No. 3,015,448 dated Mar. 31, 2023.

Office Action issued in Corresponding Russian Application No. 2018132872, dated May 22, 2020 (English Translation Provided).

* cited by examiner

PUSH THE BIT ROTARY STEERABLE SYSTEM

CROSS-REFERENCE TO RELATED APPLICATIONS

This application is a continuation of U.S. patent application Ser. No. 18/303,753, filed Apr. 20, 2023, which is a continuation of U.S. patent application Ser. No. 17/341,109, filed Jun. 7, 2021, now U.S. Pat. No. 11,649,680, which is a continuation of U.S. patent application Ser. No. 15/999,107, filed Aug. 17, 2018, now U.S. Pat. No. 11,028,645, which is a national phase application under 35 U.S.C. § 371 of International Patent Application PCT Application No. PCT/IB2017/000233, filed Feb. 20, 2017, which is a continuation of Ser. No. 15/046,963, filed Feb. 18, 2016, now U.S. Pat. No. 9,624,727. The entire contents of the foregoing applications are incorporated herein by reference.

TECHNICAL FIELD

The present disclosure relates generally to a rotary steerable tool and more particularly to systems, methods, and devices for pushing a drill bit using a downhole actuation system.

BACKGROUND

Field formations can include reservoirs holding one or more resources. To reach such reservoirs so that the resources can be extracted, one or more holes are drilled through the field formations. Various drilling techniques can be used when creating a wellbore in an exploration process.

One or more such techniques involve the use of rotary steerable tools. Rotary steerable tools are used to direct the path of wellbores when drilling for resources. One application in which rotary steerable tools are used is when an entity is drilling multiple wells in different directions from one location. Another application in which rotary steerable tools are used is when an entity is positioning a wellbore horizontally along the length of a reservoir to maximize the amount of resources collected.

SUMMARY

In general, in one aspect, the disclosure relates to a method for pushing a rotary drill bit. The method can include receiving a target direction in a formation to push the rotary drill bit while drilling a wellbore in a formation. The method can also include opening, at a first rotational position of a rotary bit pushing device disposed proximate to the rotary drill bit within the wellbore, a first inlet port of a first flow regulator, where the first inlet port, when in an open position, allows a first quantity of drilling fluid to move a first deflection device of a plurality of deflection devices of the rotary bit pushing device from a normal position to an extended position, where the first deflection device, when in the extended position, contacts the formation bounding the wellbore. The method can further include closing, after the first rotational position of the rotary bit pushing device, the first inlet port, where the first inlet port, when in a closed position, stops the first quantity of drilling fluid from flowing to the first deflection device and allows the first deflection device to return to the normal position. The method can also include sending, to a second flow regulator of the rotary bit pushing device, a second quantity of drilling fluid, where the second quantity of drilling fluid flows to the first deflection device when the first flow regulator is in the closed position. At least a portion of the first quantity of drilling fluid can flow through the first deflection device into the wellbore when the first inlet port is in the open position. At least a portion of the second quantity of drilling fluid can flow through the first deflection device into the wellbore when the first inlet port is in the closed position. The first deflection device contacting the formation when the rotary bit pushing device is in the first rotational position can push the rotary drill bit in the target direction.

In another aspect, the disclosure relates to a rotary bit pushing device. The device can include a body having at least one wall that forms a cavity, where the at least one wall has at least one aperture that traverses the at least one wall and at least one channel disposed adjacent to the at least one aperture, where the body has a proximal end and a distal end that defines the at least one wall along a length of the body. The device can also include at least one deflection device moveably disposed in the at least one aperture in the at least one wall of the body, where the at least one deflection device moves radially with respect to an axis formed along the length of the body. The device can further include at least one sealing device disposed against the at least one deflection device, where the at least one sealing device is disposed between the at least one channel and the wellbore. The device can also include at least one flow regulator disposed adjacent to the cavity and to the at least one channel, where the at least one flow regulator is configured to allow a first portion of drilling fluid flowing through the cavity of the body to pass into the at least one channel. A second portion of the drilling fluid can flow into the at least one aperture, where the second portion of the drilling fluid is controlled by at least one additional flow regulator that allows the second portion of the drilling fluid to flow into the at least one aperture based on a position of the at least one deflection device relative to a wellbore, where the first portion of the drilling fluid reaches the at least one flow regulator substantially continually.

In yet another aspect, the disclosure relates to a push the bit rotary steerable system. The system can include a rotary drill bit, and a drill string having at least one wall that forms a cavity. The system can also include a drilling fluid circulation system that sends drilling fluid through the cavity, and a rotary bit pushing device coupled to a proximal end of the drill string and a proximal end of the rotary drill bit. The rotary bit pushing device can include a body having at least one wall that forms the cavity, where the at least one wall has at least one aperture that traverses the at least one wall and at least one channel disposed adjacent to the at least one aperture. The rotary bit pushing device can also include at least one deflection device disposed in the at least one aperture in the at least one wall of the body. The rotary bit pushing device can further include at least one sealing device disposed around the at least one deflection device, where the at least one sealing device is disposed within the at least one cavity adjacent to the at least one wall of the body, where the at least one sealing device is further disposed between the at least one channel and the wellbore, where the at least one sealing device divides the at least one aperture into a distal portion and a proximal portion, where the proximal portion of the at least one aperture is adjacent to the at least one channel. The rotary bit pushing device can also include at least one flow regulator disposed adjacent to the cavity and to the at least one channel, where the at least one flow regulator is configured to allow a first portion of drilling fluid flowing through the cavity of the body to pass into the at least one channel. A second portion of the drilling fluid can flow into the at least one aperture, where the second portion of the drilling fluid is controlled by at least one additional flow regulator that allows the second portion of the drilling fluid to flow into the at least one aperture based on a position of the at least one deflection device relative to a wellbore, where the first portion of the drilling fluid reaches the at least one flow regulator substantially continually.

These and other aspects, objects, features, and embodiments will be apparent from the following description and the appended claims.

BRIEF DESCRIPTION OF THE DRAWINGS

The drawings illustrate only example embodiments and are therefore not to be considered limiting of its scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
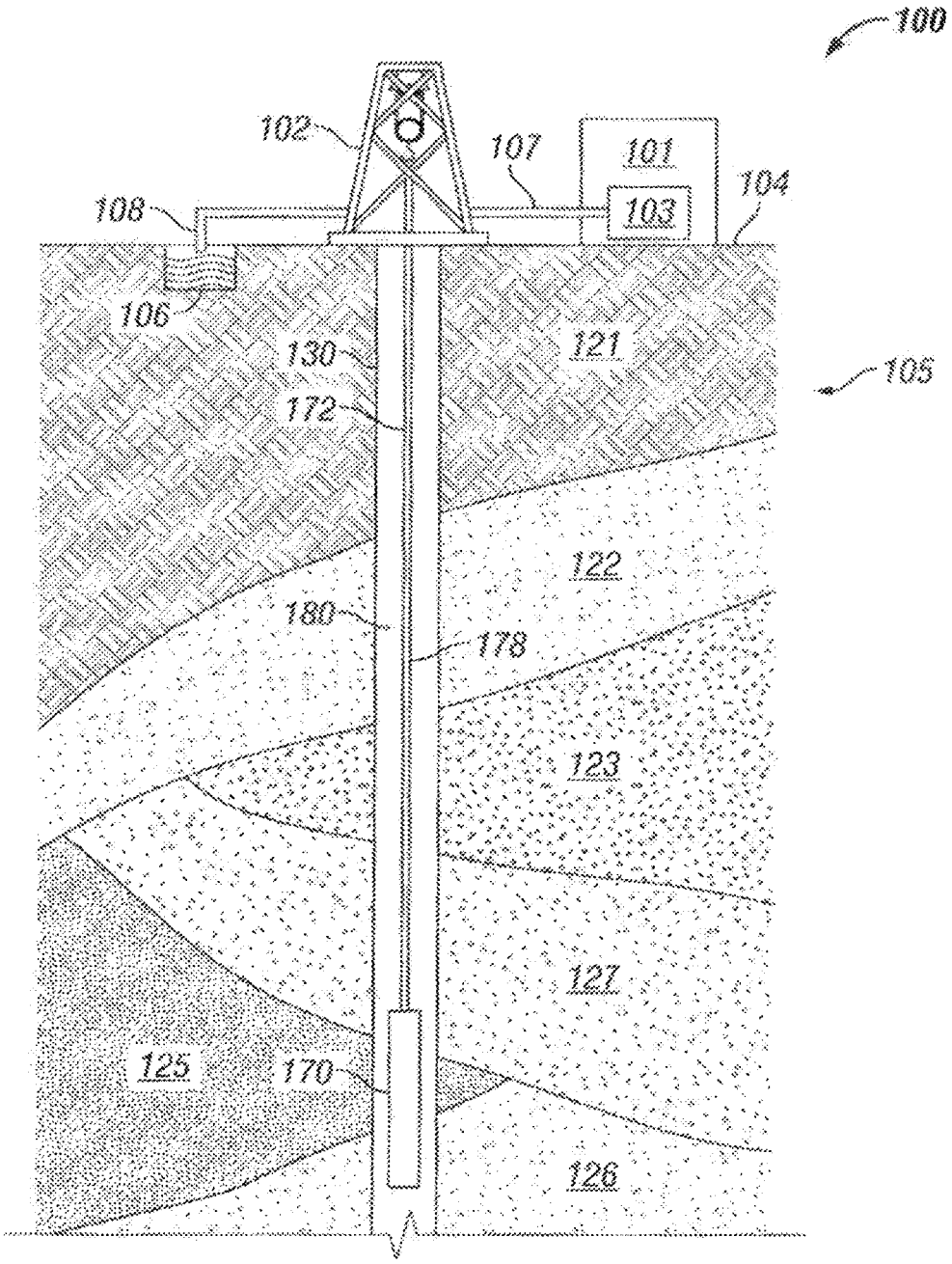
FIG. 1 shows a schematic view, partially in cross section, of a field undergoing exploration using an example push the rotary bit pushing device in accordance with one or more example embodiments.

In general, the example embodiments described herein provide systems, methods, and devices for pushing a rotary drill bit. More specifically, the example embodiments provide for controlling a direction in which a drill bit pushes during an operation (e.g., exploration, production) in a field. For clarification, a field can include part of a subterranean formation. More specifically, a field as referred to herein can include any underground geological formation containing a resource (also called a subterranean resource) that may be extracted. Part, or all, of a field may be on land, water, and/or sea. Also, while a single field measured at a single location is described below, any combination of one or more fields, one or more processing facilities, and one or more wellsites can be utilized. The subterranean resource can include, but is not limited to, hydrocarbons (oil and/or gas), water, steam, helium, and minerals. A field can include one or more reservoirs, which can each contain one or more subterranean resources.

When a drill bit is pushed to steer the bottom hole assembly, the drill bit is directed to a target location (also called a target direction) in the wellbore. Because the bottom hole assembly (as well as the entire drill string) is rotating, pushing the drill bit at the target location can be challenging. In other words, the point to which the drill bit is directed is stationary within the wellbore, but the drill bit itself is rotating during the field operation. In some cases, example embodiments can make constant adjustments to keep the drill bit pushed at the target location during the field operation. As defined herein, example embodiments are described as pushing a drill bit, even though example embodiments are located proximate to, but not integral with, the drill bit. Rather, example embodiments push against a particular location along the wall of a wellbore to control the direction of the drill bit.

When the bottom hole assembly rotates relative to the target location, there can be a number of rotational positions of the bottom hole assembly (taken radially from the axis along the length of the bottom hole assembly) relative to the target location. The rotational positions can be discrete or continuous. The sum of the rotational positions can cover a full rotation (360°) of the bottom hole assembly. As defined herein, a liquid-tight seal is a barrier that prevents all or a substantial amount of liquid (e.g., drilling fluid, drilling mud) from passing therethrough. In one or more example embodiments, a user is any entity that uses the systems and/or methods described herein. For example, a user may be, but is not limited to, a drilling engineer, a company representative, a manufacturer's representative, a control system, a contractor, an engineer, a technician, a consultant, or a supervisor. The push the bit rotary steerable systems (or components thereof) described herein can be made of one or more of a number of suitable materials to effectively operate while also maintaining durability in light of the one or more conditions under which the push the bit rotary steerable systems can be exposed. Examples of such materials can include, but are not limited to, aluminum, stainless steel, fiberglass, glass, plastic, ceramic, and rubber.

Example push the bit rotary steerable systems, or portions thereof, described herein can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, mounting, fastening, securing, or other similar terms. Such terms are merely meant to distinguish various elements and/or features within a component or device and are not meant to limit the capability or function of that particular element and/or feature. For example, a feature described as a "coupling feature" can couple, mount, secure, fasten, abut against, and/or perform other functions aside from merely coupling.

A coupling feature (including a complementary coupling feature) as described herein can allow one or more components and/or portions of an example push the bit rotary steerable system (e.g., a rotary bit pushing device, a deflection device) to become mechanically coupled, directly or indirectly, to another portion of the push the bit rotary steerable system. A coupling feature can include, but is not limited to, a portion of a hinge, an aperture, a recessed area, a protrusion, a clamp, a slot, a spring clip, a tab, a detent, and mating threads. One portion of an example push the bit rotary steerable system can be coupled to a component of the push the bit rotary steerable system by the direct use of one or more coupling features.

In addition, or in the alternative, a portion of an example push the bit rotary steerable system can be coupled to a component of a push the bit rotary steerable system using one or more independent devices that interact with one or more coupling features disposed on a component of the push the bit rotary steerable system. Examples of such devices can include, but are not limited to, a pin, a hinge, a fastening device (e.g., a bolt, a screw, a rivet), a clamp, and a spring. One coupling feature described herein can be the same as, or different than, one or more other coupling features described herein. A complementary coupling feature as described herein can be a coupling feature that mechanically couples, directly or indirectly, with another coupling feature.

In the foregoing figures showing example embodiments of push the bit rotary steerable systems, one or more of the components shown may be omitted, repeated, and/or substituted. Accordingly, example embodiments of push the bit rotary steerable systems should not be considered limited to the specific arrangements of components shown in any of the figures. For example, features shown in one or more figures or described with respect to one embodiment can be applied to another embodiment associated with a different figure or description.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

Example embodiments of push the bit rotary steerable systems will be described more fully hereinafter with reference to the accompanying drawings, in which example embodiments of push the bit rotary steerable systems are shown. Push the bit rotary steerable systems may, however, be embodied in many different forms and should not be construed as limited to the example embodiments set forth herein. Rather, these example embodiments are provided so that this disclosure will be thorough and complete, and will fully convey the scope of push the bit rotary steerable systems to those of ordinary skill in the art. Like, but not necessarily the same, elements (also sometimes called components) in the various figures are denoted by like reference numerals for consistency.

Terms such as "first", "second", "top", "bottom", "side", "width", "length", "radius", "inner", and "outer" are used merely to distinguish one component (or part of a component or state of a component) from another. Such terms are not meant to denote a preference or a particular orientation, and are not meant to limit embodiments of push the bit rotary steerable systems. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 is a schematic view, partially in cross section, of a field 100 undergoing exploration using an example push the rotary bit pushing device in accordance with one or more example embodiments. Referring to FIG. 1, the field 100 is subterranean and can include a bottom hole assembly 170 that is suspended by a rig 102 at the surface 104 using drill pipe 172 (also called a drill string 172) and advanced into the subterranean formation 105 to form a wellbore 130. The subterranean formation 105 can have a number of geological structures. For example, as shown in FIG. 1, the subterranean formation 105 can have a clay layer 121, a sandstone layer 122, a limestone layer 123, a shale layer 127, a sand layer 125, and a reservoir 126.

Data acquisition tools and/or sensing devices can be used to measure the subterranean formation 105 and detect the characteristics of the various layers of the subterranean formation 105. The data collected by data acquisition tools, as well as other data measured by one or more sensing devices located at various locations (e.g., the mud pit 106, at the surface 104, on the rig 102) in the field 100, can be gathered and processed by a data acquisition system 101 that is communicably coupled to the various data acquisition tools and/or sensing devices. In certain example embodiments, the data acquisition system 101 can perform other functions with respect to the field data, including but not limited to generating models, and communicating with (generating signals, sending signals, receiving signals) one or more devices in the field 100, including but not limited to the control device (described below with respect to FIGS. 3A-C).

For example, as shown in FIG. 1, the data acquisition system 101 can include a controller 103. In such a case, the controller 103 can control one or more flow regulators (e.g., flow regulator 280 in FIG. 7, described below) used with example embodiments. The controller 103 can also coordinate with another portion of the data acquisition system 101 to determine the orientation of an example rotary bit pushing device (described below) in a wellbore at any point in time. The data acquisition system 101, or any portion thereof, can communicate with one or more devices in the field 100 using a communication link 107, which can use wired and/or wireless technology.

Fluids are circulated in a substantially closed-loop system to assist in the drilling process. Drilling fluid 178 is pumped down the annulus of the drill pipe 172 and the bottom hole assembly 170. As the drill bit at the end of the bottom hole assembly 170 cuts into the subterranean formation 105, pieces of the subterranean formation 105 are mixed in with the drilling fluid 178 to create drilling mud 180 within the wellbore between the subterranean formation 105 and the outside of the drill pipe 172 and bottom hole assembly 170. The drilling mud 180 is drawn back to the surface 104 to a mud pit 106 via a flow line 108.

The mud pit 106 filters the drilling mud 180, removing the larger bits (e.g., rock) of the subterranean formation 105, to return the fluid to drilling fluid 178, which is again pumped down the annulus of the drill pipe 172. The bottom hole assembly 170 is advanced into the subterranean formation to reach a reservoir 126. Each well can target one or more reservoirs 126. The bottom hole assembly 170 can be adapted for measuring downhole properties using logging while drilling (LWD) tools, measurement while drilling (MWD) tools, and/or any other suitable measuring tool (also called data acquisition tools).

The data acquisition tools can be integrated with the bottom hole assembly 170 and generate data plots and/or measurements. These data plots and/or measurements are depicted along the field 100 to demonstrate the data generated by the various operations. While only a simplified configuration of the field 100 is shown, it will be appreciated that the field 100 can cover a portion of land, sea, and/or water locations that hosts one or more wellsites. Production can also include one or more other types of wells (e.g., injection wells) for added recovery. One or more gathering facilities can be operatively connected to one or more of the wellsites for selectively collecting downhole fluids and/or resources from the wellsite(s).

Further, while FIG. 1 describes data acquisition tools and/or sensing devices used to measure properties of a field, it will be appreciated that the tools and/or devices can be used in connection with non-wellsite operations, such as mines, aquifers, storage, or other subterranean facilities. Also, while certain data acquisition tools (e.g., bottom hole assembly 170, data acquisition system 101) are depicted, it will be appreciated that various other measurement tools (e.g., sensing parameters, seismic devices) measuring various parameters of the subterranean formation 105 and/or its geological formations can be used. Various sensors can be located at various positions along the wellbore and/or as part of the monitoring tools to collect and/or monitor the desired data. Other sources of data can also be provided from offsite locations.

When a data acquisition tool and/or other device (e.g., the controller 103) is incorporated with the bottom hole assembly 170, such tools and/or devices can communicate with the data acquisition system 101 and/or controller 103 in one or more of a number of ways. The data acquisition system 101 and/or controller 103 can communicate with a data acquisition tool and/or a measuring device using wired and/or wireless technology. As an example of using a wireless technology, the data acquisition system 101 and/or controller 103 can communicate with a downhole tool and/or device using energy waves that are transported through the drilling fluid 178 during a field operation.

Figure 2:
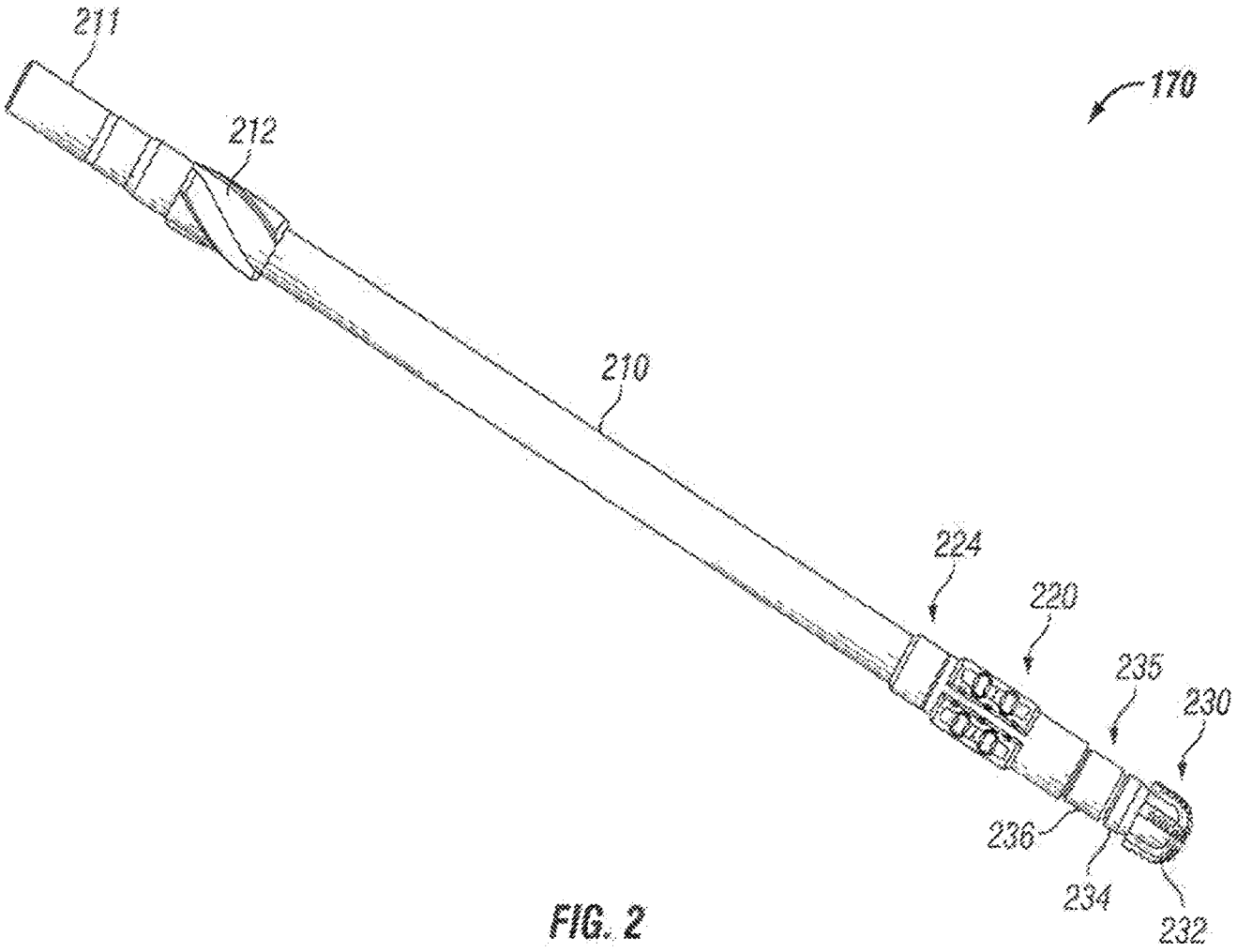
FIG. 2 shows a side view of a bottom hole assembly that includes an example push the rotary bit pushing device in accordance with one or more example embodiments.

FIG. 2 shows a side view of a bottom hole assembly 170 that includes an example rotary bit pushing device 220 in accordance with one or more example embodiments. Referring now to FIGS. 1 and 2, the bottom hole assembly 170 of FIG. 2 includes a drill collar 210 positioned between an upper sleeve stabilizer 212, and the push the rotary bit pushing device 220. The bottom hole assembly 170 also includes a drill bit assembly 230 located at the end of the bottom hole assembly 170, below the push the rotary bit pushing device 220. Another drill collar 211 can also be located on the opposite side of (further uphole from) the upper stabilizer 212.

The drill collars 210, 211 can be pipes of a known inner diameter and outer diameter along a known length and have substantially uniform thickness along the length. The drill collars 210, 211 can be made of one or more of a number of suitable materials for the environment in which the field operation is being performed. Examples of such materials can include, but are not limited to, stainless steel and galvanized steel. A cavity, defined by the inner diameter, traverses the length of each drill collar (e.g., drill collar 210, drill collar 211).

The upper sleeve stabilizer 212 can mechanically stabilize the bottom hole assembly 170 in the borehole in order to avoid unintentional sidetracking and/or vibrations, and/or to ensure the quality of the hole being drilled. In certain example embodiments, the upper sleeve stabilizer 212 can include a hollow cylindrical body and stabilizing blades disposed on the outer surface of the body, all made of high-strength steel and/or some other suitable material. The blades of the upper sleeve stabilizer 212 can have one or more of a number of shapes, including but not limited to straight and spiraled. The blades can be hardfaced for wear resistance.

The upper sleeve stabilizer 212 can be integral (i.e., formed from a single piece of material such as steel) or a composite of multiple pieces mechanically coupled together. An example of the latter case can be an upper sleeve stabilizer 212 where the blades are located on a sleeve, which is then screwed on the body of the upper sleeve stabilizer 212. Another example of the latter case is an upper sleeve stabilizer 212 where the blades are welded to the body. In certain example embodiments, the bottom hole assembly 170 can include more than one stabilizer located at various points along the bottom hole assembly 170. For example, as shown in FIG. 2, the bottom hole assembly 170 can also include a near bit stabilizer 224 disposed between drill collar 210 and the rotary bit pushing device 220.

The drill collars 210, 211, the stabilizers (e.g., the upper sleeve stabilizer 212, the near-bit stabilizer 224), the drill bit assembly 230, and/or any other components of the bottom hole assembly 170 are mechanically coupled to each other using one or more of a number of coupling methods. For example, as is common in the industry, such components are coupled to each other using mating threads that are disposed on each end of each component. When such components of the bottom hole assembly 170 are mechanically coupled to each other, the coupling is conducted in such a way as to comply with engineering and operational requirements. For example, when mating threads are used, a proper torque is applied to each coupling.

Much of the push the rotary bit pushing device 220 is described below with respect to FIGS. 3A-7. In FIG. 2, most of the push the rotary bit pushing device 220 is hidden from view. The portions of the rotary bit pushing device 220 that are visible in FIG. 2 (and which are described in more detail below with respect to FIGS. 3A-3C) are the deflection devices 240, the deflection device holders 250, and the outer surface of the body 221.

The drill bit assembly 230 includes a drill bit 232, and a drill bit collar 234. In FIG. 2, only the collar 236 of the bit shaft 235 (located at the distal end of the bit shaft 235) is shown, while the rest of the bit shaft 235 is hidden from view by the rotary bit pushing device 220. The bit shaft 235 may be part of, or a separate component that is coupled to, the push the rotary bit pushing device 220. The bit shaft 235 can have a cavity that traverses along its length. The bit shaft 235 can have multiple features. For example, the collar 236 of the bit shaft 235 can include one or more coupling features (e.g., mating threads) that mechanically couples to the proximal end of the drill bit collar 234. Similarly, the proximal end of the bit shaft 235 (hidden from view) can include one or more coupling features that allow the bit shaft 235 to couple to another component (e.g., the rotary bit pushing device 220) of the bottom hole assembly 170.

The proximal end of the drill bit collar 234 is mechanically coupled to the distal end of the bit shaft 235, while the distal end of the drill bit collar 234 is mechanically coupled to the drill bit 232. The drill bit 232 and the drill bit collar 234 can be formed as a single piece (as from a mold) or from multiple pieces that are mechanically coupled to each other using one more of a number of coupling methods, including but not limited to welding, mating threads, and compression fittings.

The drill bit 232 is a tool used to crush and/or cut rock. The drill bit 232 is located at the distal end of the bottom hole assembly 170 and can be any type (e.g., a polycrystalline diamond compact bit, a roller cone bit, an insert bit) of drill bit having any dimensions (e.g., 5 inch diameter, 9 inch diameter, 50 inch diameter) and/or other characteristics (e.g., rotating cones, rotating head, rotating cutters). The drill bit 232 can include one or more of a number of materials, including but not limited to steel, diamonds, and tungsten carbide.

Figure 3A:
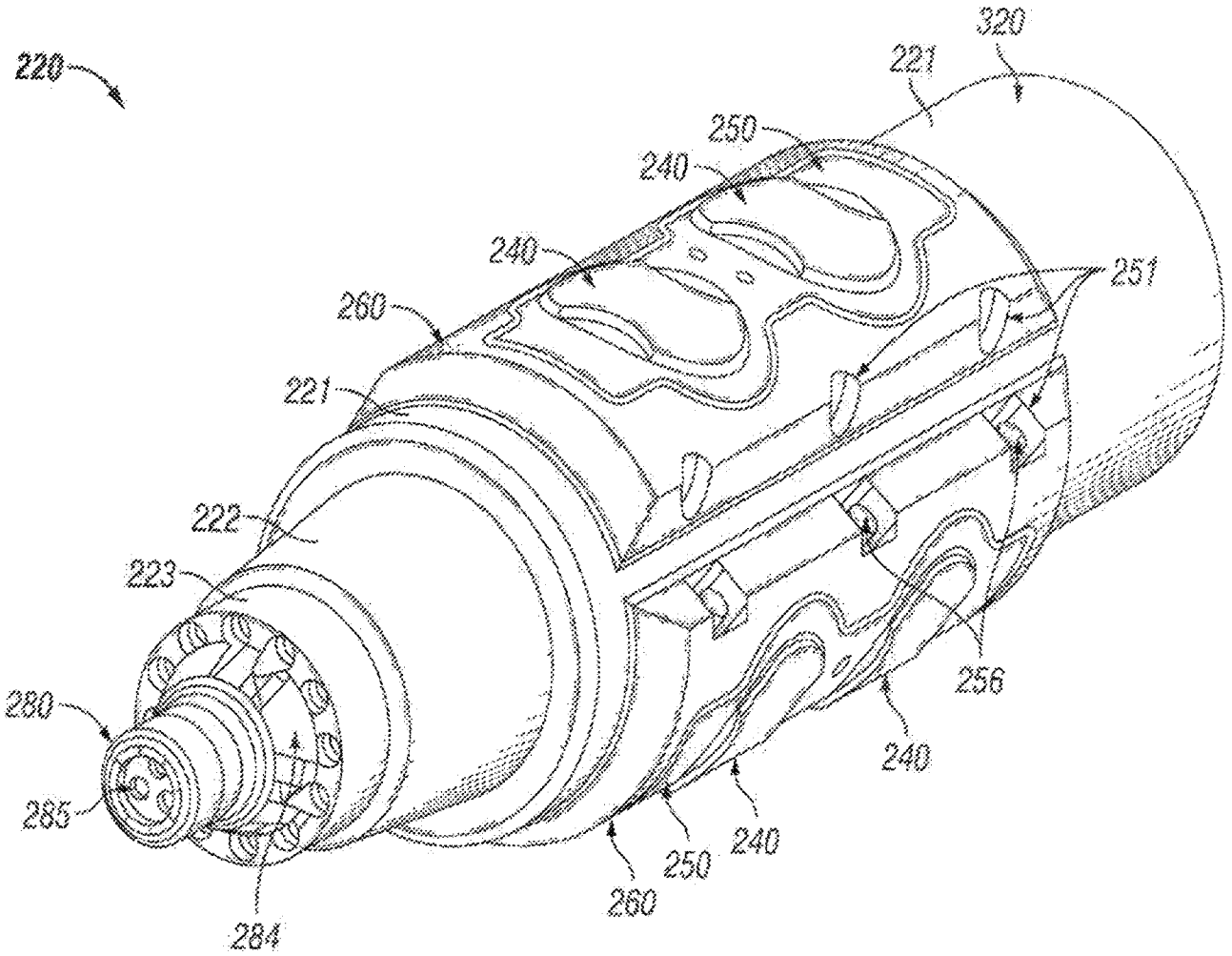
FIGS. 3A-C shows various views of an example rotary bit pushing device in accordance with one or more example embodiments.
Figure 3B:
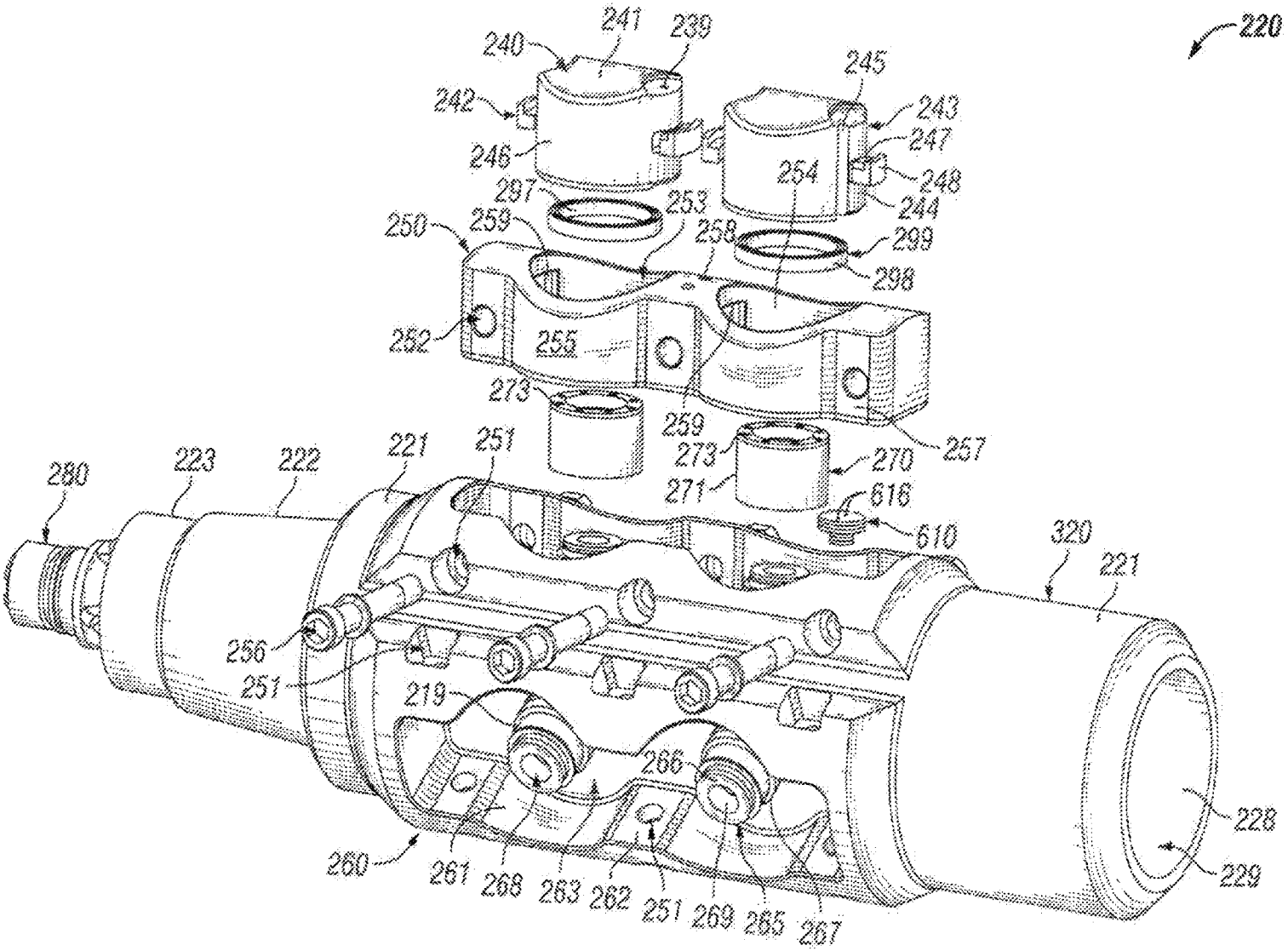
Figure 3C:
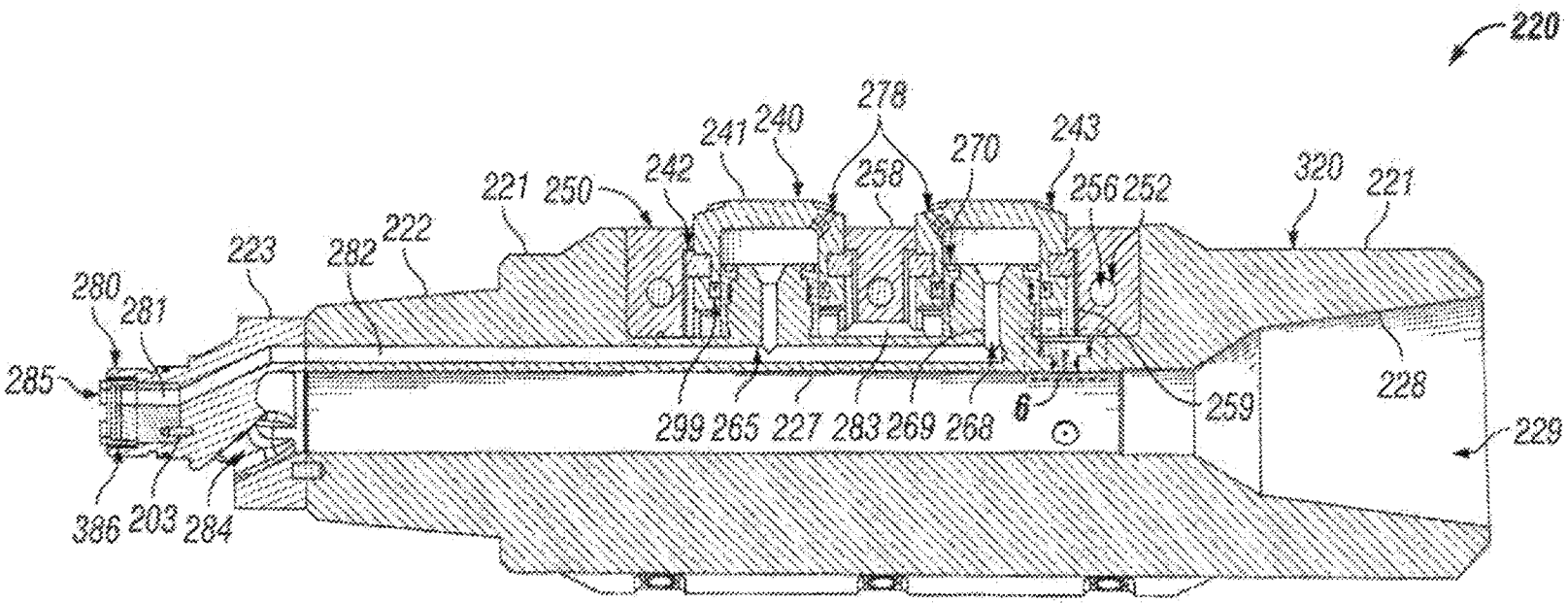
Figure 4A:
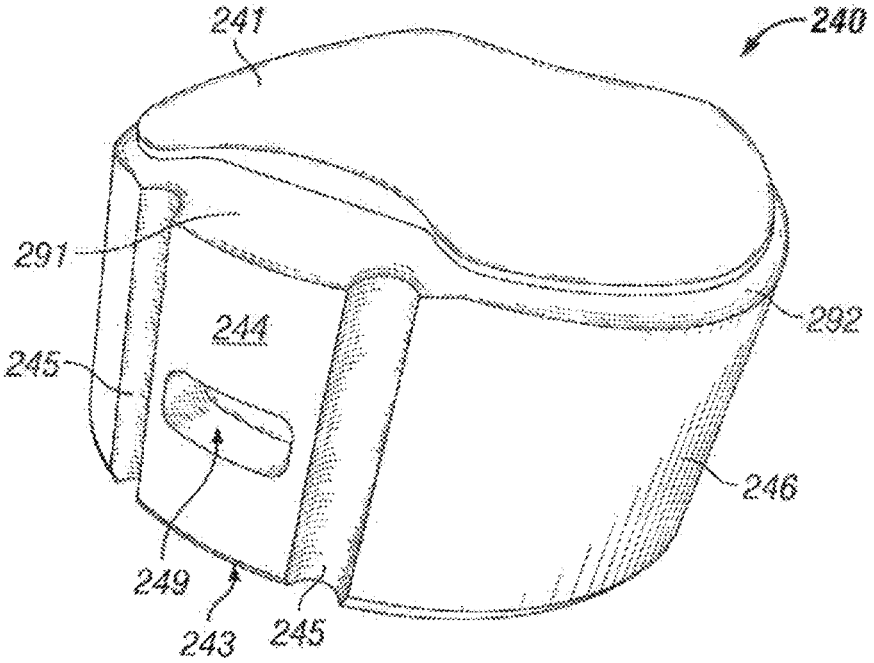
FIGS. 4A-4D show various views of a deflection device in accordance with one or more example embodiments.
Figure 4B:
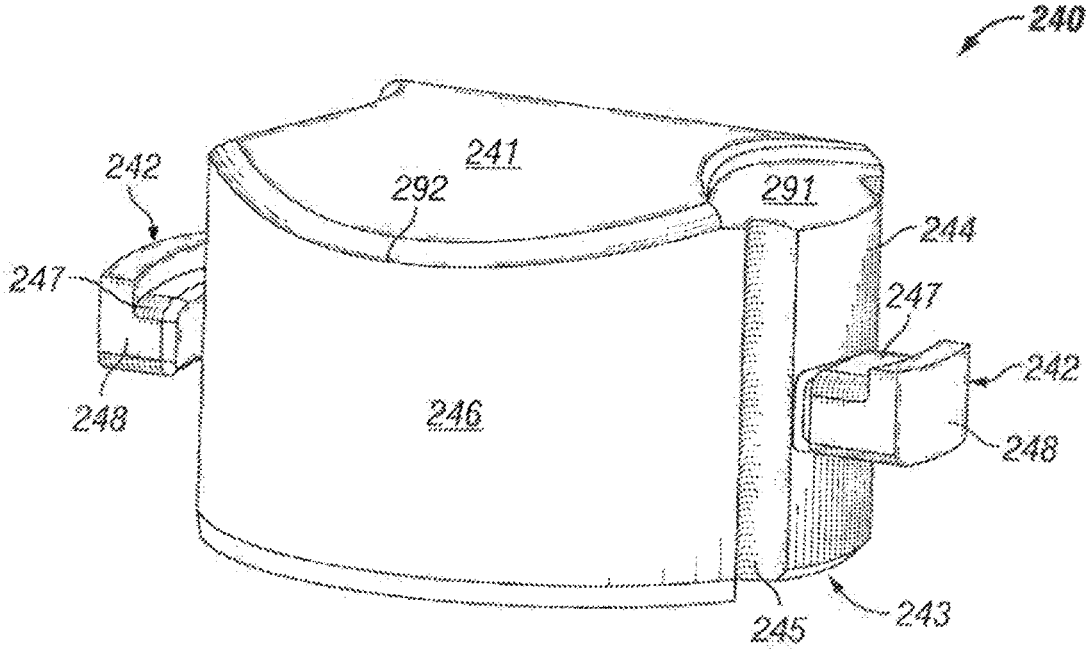
Figure 4C:
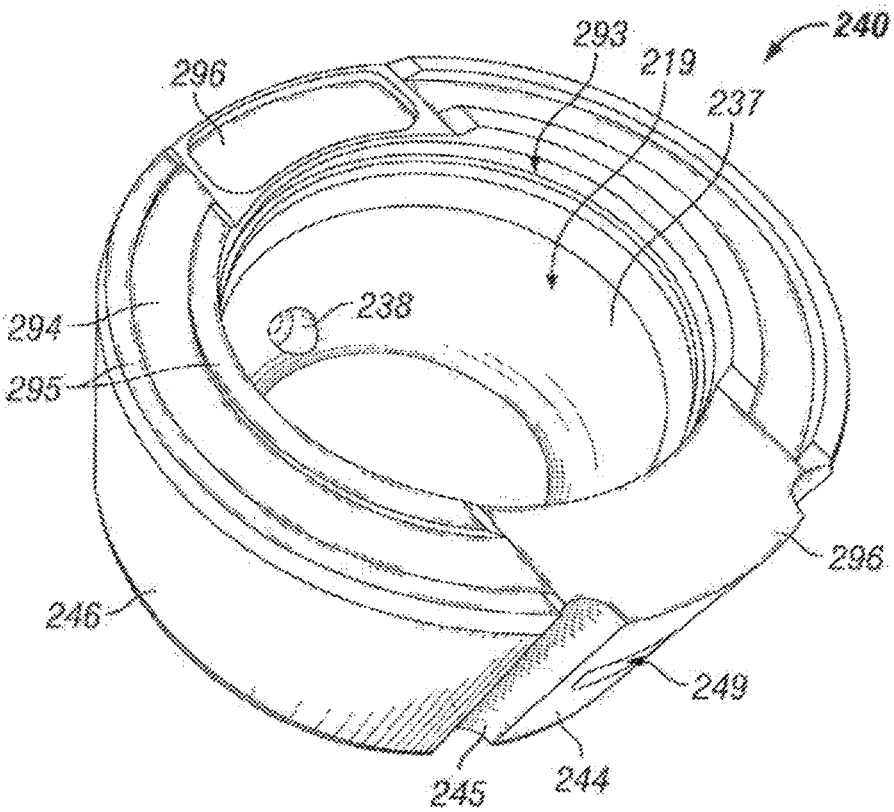
Figure 4D:
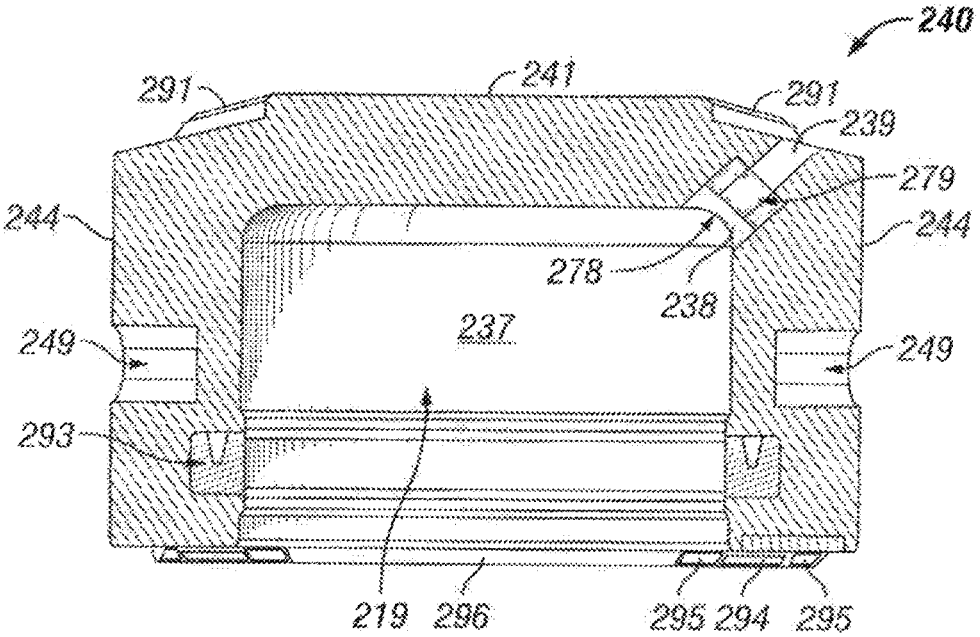

FIGS. 3A-C shows various views of an example push the rotary bit pushing device 220 in accordance with one or more example embodiments. Specifically, FIG. 3A shows a top-side perspective view of the rotary bit pushing device 220. FIG. 3B shows an exploded view of the rotary bit pushing device 220. FIG. 3C shows a cross-sectional side view of the rotary bit pushing device 220. FIGS. 4A-4D shows various views of a deflection device 240 of the rotary bit pushing device 220 in accordance with one or more example embodiments. Specifically, FIGS. 4A and 4B each shows a top-side perspective view of the deflection device 240. FIG. 4C shows a bottom-side perspective view of the deflection device 240. FIG. 4D shows a cross-sectional side view of the deflection device 240.

Figure 5A:
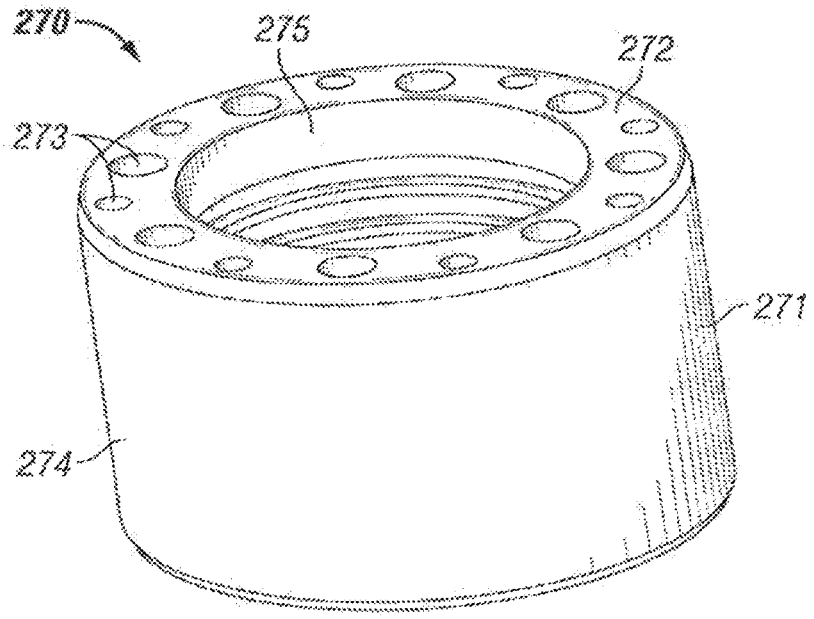
FIGS. 5A and 5B show various views of a sleeve for a deflection device in accordance with one or more example embodiments.
Figure 5B:
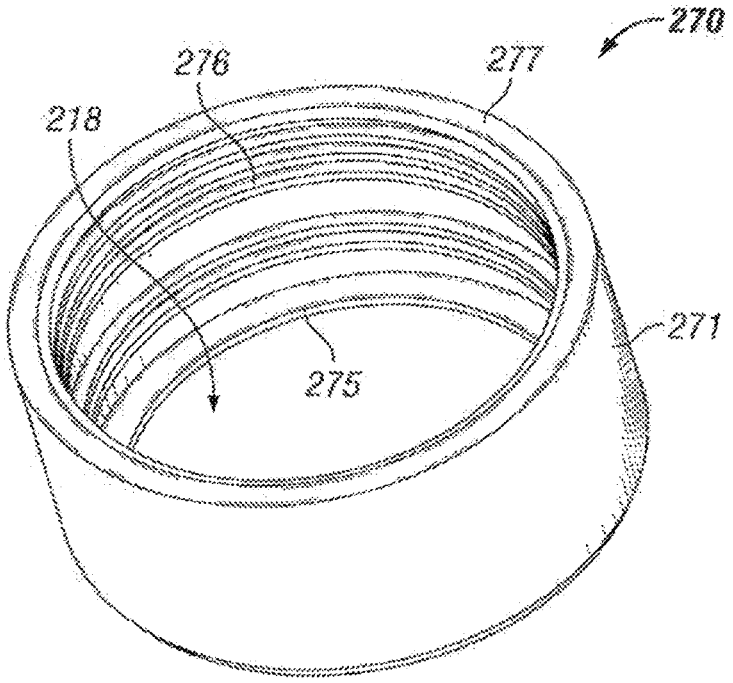
Figure 6:
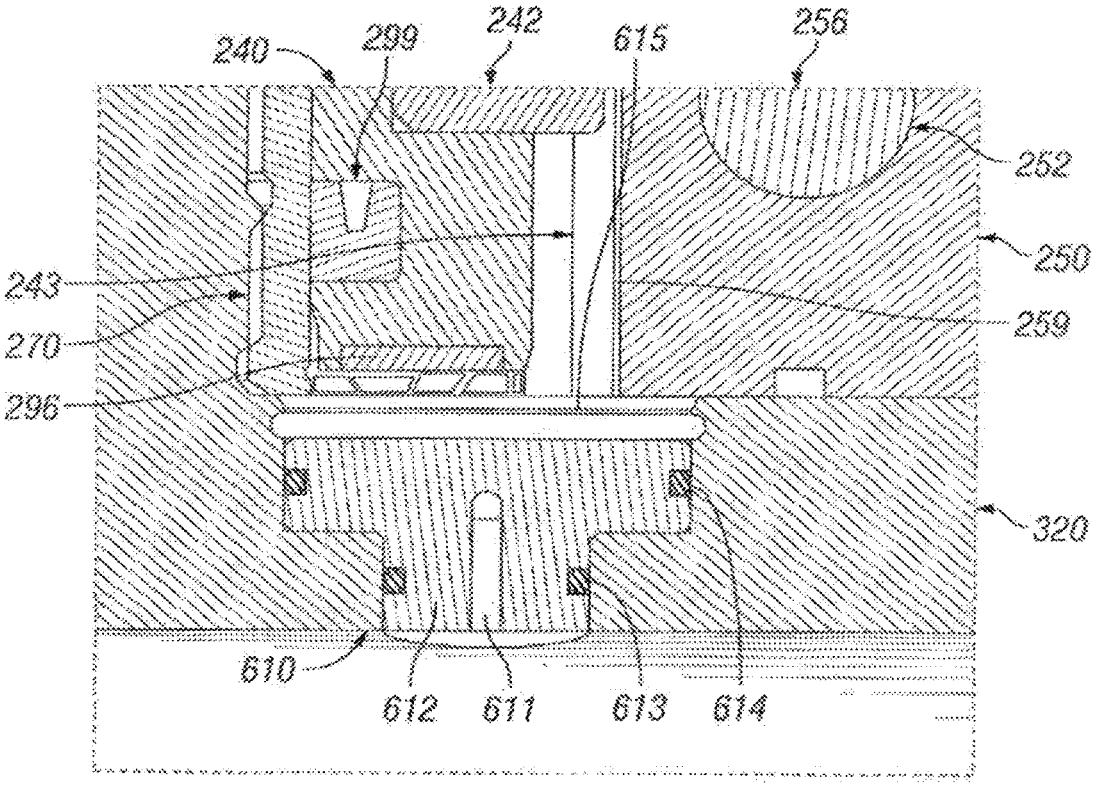
FIG. 6 shows a flow control device in accordance with one or more example embodiments.
Figure 7:
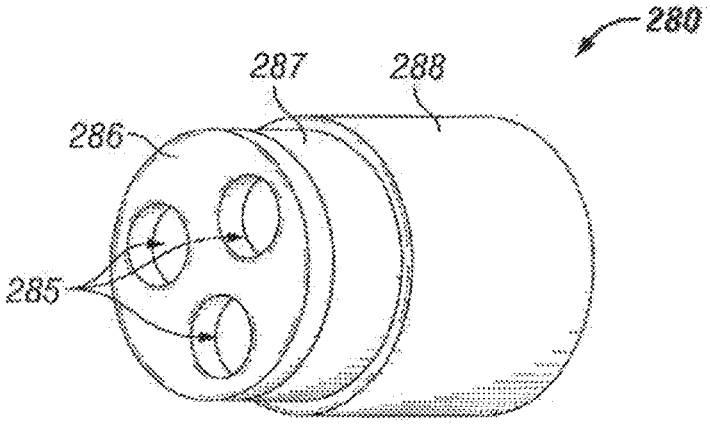
FIG. 7 shows a flow control device assembly in accordance with one or more example embodiments.

FIGS. 5A and 5B show a top-side perspective view and a bottom-side perspective view, respectfully, of an inner deflection device sleeve 270 in accordance with one or more example embodiments. FIG. 6 shows a cross-sectional side view detailing a flow regulator 610 of the rotary bit pushing device 220 in accordance with one or more example embodiments. FIG. 7 shows a side perspective view of another flow regulator 280 of the rotary bit pushing device 220 in accordance with one or more example embodiments.

Referring to FIGS. 1-7, the rotary bit pushing device 220 can include a number of different components. For example, as shown in FIGS. 3A-3C, the rotary bit pushing device 220 can include a body 320, at least one deflection device 240, at least one sealing device 299, at least one inner deflection device sleeve 270, at least one flow regulator 610, a flow regulator 280, at least one outer deflection device sleeve 250, and at least one deflection device mounting platform 260.

In certain example embodiments, the body 320 of the rotary bit pushing device 220 includes at least one wall (e.g., wall 221, wall 222, wall 223). At least one of the walls (in this case, wall 221) can include one or more apertures 263 that traverse the wall. Also, the walls of the body 320 can have one or more inner surfaces (in this case, inner surface 227 and inner surface 228) that form a cavity 229 that traverses the length of the body 320. Through the cavity 229 can flow drilling fluid 178. The body 320 can have a proximal end (at the left side of FIGS. 3A-3C) and a distal end (at the right side of FIGS. 3A-3C). The length of the body 320 is defined by the proximal end and the distal end.

The proximal end and the distal end of the body 320 can include one or more coupling features (e.g., mating threads) that allow the body 320 to couple to one or more components (e.g., near bit stabilizer 224, bit shaft 235) of the bottom hole assembly 170. The one or more apertures 263 in the body 320 can have characteristics (e.g., shape, size) sufficient to receive one or more other components of the rotary bit pushing device 220. For example, as shown in FIGS. 3A-3C, the apertures 263 in the body 320 can receive and be coupled to one or more outer deflection device sleeves 250 (discussed below).

In certain optional example embodiments, as shown in FIGS. 3A-3C, the body 320 of the rotary bit pushing device 220 can include one or more deflection device mounting platforms 260. In such a case, a deflection device mounting platform 260 can be integrated with (e.g., form a single piece with) the body 320. Alternatively, a deflection device mounting platform 260 can be a separate piece that is mechanically coupled to the body 320. A deflection device mounting platform 260 can protrude outward from the body 320 in a radial direction relative to an axis defined along the length of the body 320.

A deflection device mounting platform 260 (or another portion of the body 320) can include one or more coupling features 251 (in this case, apertures that traverse the deflection device mounting platform 260 and/or the body 320) that are used to couple the body 320, directly or indirectly, to one or more other components of the rotary bit pushing device 220. For example, as shown in FIGS. 3A-3C, an outer deflection device sleeve 250, disposed within an aperture 263 of the body 320, can be indirectly coupled to a deflection device mounting platform 260 of the body 320 using one or more coupling devices 256 (in this case, bolts and washers) that traverse the coupling features 251 in the deflection device mounting platform 260 and corresponding coupling features 252 (in this case, apertures) that traverse at least a portion of the outer deflection device sleeve 250.

In certain example embodiments, the body 320 can include at least one channel 282 disposed within the body 320. In other words, the channel 282 can be disposed between an inner surface (e.g., inner surface 227) and an outer surface of one or more walls (in this case, wall 223, wall 222, and wall 221) of the body 320. Each channel 282 can have characteristics (e.g., cross-sectional shape, cross-sectional size, length, curvature, bends, straight segments) sufficient to allow drilling fluid 178 to flow therethrough. Each channel 282 can be disposed between the flow regulator 280 (described below and disposed at the proximal end of the body 320) and one or more nozzles 265.

Each of the one or more nozzles 265 of the body 320 can be disposed with an aperture 263 in a wall of the body 320 and is coupled to some portion (e.g., the distal end, toward the distal end) of a channel 282. In certain example embodiments, each nozzle 265 is configured to direct drilling fluid 178 to a point where a deflection device 240 can be moved from a normal position to an extended position. In this case, a nozzle 265 directs drilling fluid 178 into a cavity 219 of a deflection device 240. As such, a nozzle 265 can be disposed proximate to an underside of (within the cavity formed by) a deflection device 240.

A nozzle 265 can have any of a number of features and/or configurations. An example of a nozzle 265 is shown in FIGS. 3B and 3C. In this case, a nozzle 265 has a body 267 with a channel 268, formed by an inner surface 269, disposed therein. The outer surface of the body 267 of a nozzle 265 can have one or more coupling features 219 (in this case, mating threads) disposed thereon to allow the body 267 of the nozzle 265 to couple to one or more other components (e.g., an inner deflection device sleeve 270, as in this case) of the rotary bit pushing device 220. One or more sealing devices 266 can be disposed around the body 267 of a nozzle 265 to help prevent drilling fluid 178 from flowing in places that could adversely affect the operation of the rotary bit pushing device 220. Each nozzle 265 can remain in an affixed position relative to the body 320 of the rotary bit pushing device 220.

In certain example embodiments, an inner deflection device sleeve 270 is coupled to a nozzle 265. An inner deflection device sleeve 270 can have any of a number of features and/or configurations. An example of an inner deflection device sleeve 270 is shown in FIGS. 3B, 3C, 5A, and 5B. In this case, an inner deflection device sleeve 270 has at least one wall 271 with an inner surface 275 that forms a cavity 218 that extends along the length of the inner deflection device sleeve 270. There can be one or more coupling features 276 disposed along at least a portion of the inner surface 275 of the inner deflection device sleeve 270. In this case, the coupling features 276 are mating threads that complement the coupling features 219 of a nozzle 265.

In certain example embodiments, at least a portion of the outer surface 271 of the wall 274 of the inner deflection device sleeve 270 can be smooth and featureless. The cross-sectional size and shape (when viewed from above) of the outer surface 271 of the wall 274 of the inner deflection device sleeve 270 can be substantially the same as, or slightly larger than, the cross-sectional size and shape (when viewed from above) of the inner surface 297 of the sealing device 299 (described below). In addition, the cross-sectional size and shape (when viewed from above) of the outer surface 271 of the wall 274 of the inner deflection device sleeve 270 can be substantially the same as, or slightly smaller than, the cross-sectional size and shape (when viewed from above) of the inner surface 237 of the wall 244 of a deflection device 240.

As a result, an inner deflection device sleeve 270 can be configured to remain affixed to nozzle 265 while allowing a deflection device 240 to move up and down relative to (along the length of) the inner deflection device sleeve 270. When the deflection device 240 moves up and down relative to the inner deflection device sleeve 270, the sealing device 299, which is lodged within a channel of the deflection device 240 (as described below), slides along the smooth and featureless outer surface 271 of the wall 274 of the inner deflection device sleeve 270. When this occurs, a liquid-tight seal can be maintained between the sealing device 299 and the inner deflection device sleeve 270.

An inner deflection device sleeve 270 can also include a number of relief features 273 disposed along the top surface 272 of the wall 274 of the inner deflection device sleeve 270. The relief features 273 can have any of a number of forms and/or characteristics. For example, in this case, the relief features 273 are apertures of varying outer perimeters that traverse a portion of the wall 274 of the inner deflection device sleeve 270. In some cases, an inner deflection device sleeve 270 can be considered part of a deflection device 240.

In certain optional example embodiments, one or more outer deflection device sleeves 250 are used to retain one or more deflection devices 240 and control the movement (e.g., path of travel, limitation of movement) of each deflection device 240. If an outer deflection device sleeve 250 is not present, then the features described below with respect to the outer deflection device sleeve 250 can be incorporated into the body 320 of the rotary bit pushing device 220. The outer deflection device sleeve 250 can have one or more apertures 253, defined by an inner surface 254, that traverse the entire height of the outer deflection device sleeve 250. In such a case, the characteristics (e.g., cross-sectional shape, cross-sectional size, height, coupling features 259) of the aperture 253 and the inner surface 254 that defines the aperture 253 can be substantially the same as (or slightly larger than) the corresponding characteristics of the deflection device 240 disposed within the aperture 253.

The coupling features 259 disposed in the inner surface 254 of the outer deflection device sleeve 250 can be configured to complement the coupling features 243 (described below) disposed on a deflection device 240. The coupling features 243 can have any of a number of forms and/or characteristics. For example, in this case, the coupling features 243 are recesses that extend along a portion of the height of the outer deflection device sleeve 250. The purpose of the coupling features 243 is to allow a deflection device 240 to slide up and down (radially in and out relative to an axis along the length of the rotary bit pushing device 220) in a limited range of motion. The coupling features 243 also prevent the deflection device 240 from rotating or otherwise moving in any direction other than straight up and straight down within the aperture 253.

In certain example embodiments, an outer deflection device sleeve 250 can also include one or more channels 283 disposed toward the bottom of the outer deflection device sleeve 250 and adjacent to where a recessed segment 296 (described below) at the bottom end 295 of one or more deflection devices 240 is positioned when the deflection device 240 is disposed within the aperture 263 in the wall 221 of the body 320. Each channel 283 can be used to facilitate the flow of drilling fluid 178 from the flow regulator 610 to and/or between one or more deflection devices 240. Such drilling fluid 178 flowing through the flow regulator 610, the recessed segments 296, and the channels 283 can be used to ensure that cuttings and other debris from the wellbore 130 do not enter into and contaminate one or more portions of the rotary bit pushing device 220.

When there are one or more outer deflection device sleeves 250, an outer deflection device sleeve 250 is disposed in an aperture 263 in the wall 221 of the body 320. In such a case, the top surface 258 of the outer deflection device sleeve 250 can be substantially planar with the top surface of a deflection device mounting platform 260 (or, if there is no deflection device mounting platform 260, with the top surface of a wall (e.g., wall 221) of the body 320).

The features of the inner surface of a deflection device mounting platform 260 can complement corresponding features of the outer surface of an outer deflection device sleeve 250. For example, as shown in FIGS. 3A and 3B, adjacent to where an aperture 253 traverses an outer deflection device sleeve 250, the outer side surface 255 can protrude beyond the outer side surface 257 of the outer deflection device sleeve 250 that is not adjacent to an aperture 253. In such a case, the inner surface forming the aperture 263 in a deflection device mounting platform 260 can include a recessed portion 261 complementary to each protruding outer side surface 255 of the outer deflection device sleeve 250, as well as a non-recessed portion 262 complementary to each outer side surface 257 of the outer deflection device sleeve 250.

In this way, when an outer deflection device sleeve 250 is disposed within (e.g., coupled to) a deflection device mounting platform 260, there can be substantially no gaps therebetween. In certain example embodiments, a deflection device mounting platform 260 and/or an outer deflection device sleeve 250 can include a channel (not shown) inside of which one or more sealing devices (also not shown) can be disposed to help ensure a liquid-tight seal between the outer deflection device sleeve 250 and the deflection device mounting platform 260.

In certain example embodiments, a deflection device 240 is a movable object that is extended away from the rotary bit pushing device 220 at certain times in order to contact a wall of the wellbore 130 and thereby push the rotary drill bit 232 during a field operation. The deflection device 240 can include one or more features and/or characteristics. For example, as shown in FIGS. 3A-4D, the deflection device 240 can include a curved (e.g., convex) top surface 241. In some cases, the top surface 241 has no openings or apertures. There can be a transition portion 292 (e.g., rounded, squared) between the top surface 241 and the outer surface 246 of the deflection device. Similarly, proximate to the coupling features 243 (discussed below), there can be a transition portion 291 between the top surface 241 and the coupling features 243.

Alternatively, as shown in FIGS. 4C and 4D, the top surface 241 can include at least one drainage channel 278 that traverses the top surface 241. In such a case, the drainage channel 278 can include one or more of a number of features and/or components. For example, the drainage channel 278 can include a proximal aperture 238 adjacent to the cavity 219, an outlet channel 239 that abuts against the proximal aperture 238 and has a smaller cross-sectional size compared to that of the outlet channel 239, and flow control device 279 disposed between the outlet channel 239 and the proximal aperture 238. The drainage channel 278 can be configured to let drilling fluid 178 disposed in the cavity 219 to flow outside the cavity 219 through the drainage channel 278 without allowing drilling mud 180 in the wellbore to flow through the drainage channel 278 into the cavity 219. In addition to the top surface 241, a deflection device 240 can also include a side wall that has an inner surface 237 and an outer surface 246.

Disposed on at least one portion of the outer surface 246 can be a coupling feature 243. As discussed above, the coupling feature 243 of a deflection device 240 can be configured to complement a coupling feature 259 of an outer deflection device sleeve 250. In this case, the coupling feature 243 is a protruding section 244 that runs along the height of the deflection device 240. On either side of the protruding section 244 can be a recess 245 that also runs along the height of the deflection device 240. As discussed above, this configuration of the coupling feature 243 allows the deflection device 240 to slide up and down (radially in and out relative to an axis along the length of the rotary bit pushing device 220) relative to the outer deflection device sleeve 250. The coupling features 243 also prevent the deflection device 240 from rotating or otherwise moving in any direction other than straight up and straight down within the aperture 253 of the outer deflection device sleeve 250.

A deflection device 240 can have one coupling feature 243 or multiple coupling features 243. In certain example embodiments, as shown in FIG. 4B, the coupling feature 243 can include a stop 242. In such a case, the stop 242 can limit the amount of up and down travel of the deflection device 240 within the coupling feature 259 of the outer deflection device sleeve 250. The stop 242 can include a base portion 247 that extends laterally away from the protruding section 244 of the coupling feature 243. The stop 242 can also include an extension 248 disposed at the distal end of the base portion 247. The stop 242 can form a single piece with the protruding section 244. Alternatively, as shown in FIGS. 4A-4D, the stop 242 can be a separate piece that couples to a coupling feature 249 (e.g., an aperture) disposed on the protruding section 244.

The inner surface 237 of the deflection device 240 can form a cavity 219 that is bounded on the sides by the inner surface 237 and is bounded (or, if the drainage channel 278 is present, substantially bounded) at the top by the top surface 241. In certain example embodiments, disposed along some or all of the perimeter of the inner surface 237, is disposed a coupling feature 293 (in this case, a channel). The coupling feature 293 can be used to receive the sealing device 299. In other words, the characteristics (e.g., shape, size) of the coupling feature 293 can be designed to complement the corresponding characteristics of the sealing device 299. For example, the outer surface 298 of the sealing device 299 can abut against the inner surface of the coupling feature 293.

In certain example embodiments, the inner surface 297 of the sealing device 299 can extend into the cavity 219 beyond the 237 of the deflection device 240. In such a case, the inner surface 297 of the sealing device 299 can abut against a create a liquid-tight seal with the outer surface 271 of the wall 274 of the inner deflection device sleeve 270 while the deflection device 240 freely moves up and down (subject to coupling feature 243 of the deflection device 240 movably coupled to coupling feature 259 of the outer deflection device sleeve 250) relative to the inner deflection device sleeve 270. In certain example embodiments, the sealing device 299 can divide a deflection device 240 and/or a corresponding inner deflection device sleeve 270 into an upper portion and a lower portion, where the lower portion is below the sealing device 299 adjacent to the cavity 219 and the upper portion is above the sealing device 299.

The bottom end 295 of the deflection device 240 can include one or more features that receive and distribute drilling fluid 178 received from a flow regulator 610 (described below). For example, as shown in FIGS. 4C and 4D, the bottom end 295 of the deflection device 240 can include a recessed channel 294 bounded on the inner surface and the outer surface by the bottom end 295. In other words, the recessed channel 294 does not traverse the entire width (thickness) of the deflection device 240. The recessed channel 294 meets at least one recessed segment 296, which traverses the entire width of the deflection device 240. As a result, the recessed channel 294 and the recessed segments 296 form a continuous recessed volume of space around the entire perimeter of the bottom end 295 of the deflection device 240.

A recessed segment 296 of the deflection device 240 can be located proximate to a flow regulator 610 when the deflection device 240 is in a normal position. (When the deflection device 240 is in an extended position, the recessed segment 296 of the deflection device 240 can be located slightly further away from the flow regulator 610.) As a result, when drilling fluid 178 flows through the flow regulator 610, the drilling fluid 178 flows into the recessed segment 296. Subsequently, the drilling fluid 178 can flow from the recessed segment 296 to the recessed channel 294. The drilling fluid 178 can also flow from the recessed segment 296 to the cavity 219 of the deflection device 240.

The drilling fluid 178 in the recessed channel 294 can flow into another recessed segment 296 of the deflection device 240, and from there the drilling fluid 178 can flow into the channel 283 of the deflection device holder 283. Since the channel 283 provides a flow path between two or more adjacent deflection devices 240, the drilling fluid 178 can flow to a recessed segment 296 of one or more other deflection devices 240.

In certain example embodiments, the flow regulator 610 is a component of the rotary bit pushing device 220 that controls an amount of drilling fluid 178 that flows from the cavity 229 of the body 320 into a recessed segment 296 of a deflection device 240. This flow of the drilling fluid 178 through the flow regulator 610 can provide a substantially constant flow of drilling fluid 178 out of the deflection devices 240 (e.g., through a drainage channel 278 of a deflection device 240), which prevents cuttings and other undesired elements in the wellbore 130 from entering the rotary bit pushing device 220 or portions thereof.

A detail of an example flow regulator 610 is shown in FIG. 6. The flow regulator 610 can have any of a number of features and/or configurations. For example, as shown in FIG. 6, a flow regulator 610 can have a T-shaped body 612 with one or more sealing devices (e.g., sealing device 613, sealing device 614) disposed around an outer perimeter of the body 612. The body 612 can have a channel 611 disposed therein that traverse the height of the body. At the top of the body 612, adjacent to a recessed segment 296, can be one or more apertures 616 through which the drilling fluid 178 is released.

The channel 611 of the flow regulator 610 can be open at all times. Alternatively, the channel 611 of the flow regulator 610 can be open intermittently, as to coincide with times during the rotation of the rotary bit pushing device 220 within the wellbore 130 when the adjacent deflection devices 240 are no longer in an extended position. As another alternative, the flow of drilling fluid 178 through the channel 611 can always exist, but the amount of drilling fluid 178 flowing through the channel 611 at a given instant can vary. If the flow of drilling fluid 178 through the flow regulator 610 varies, a controller (e.g., controller 103 can control the flow of drilling fluid 178 through the flow regulator 610.

In certain example embodiments, the flow regulator 280 is a component of the rotary bit pushing device 220 that controls an amount of drilling fluid 178 that is diverted from the cavity 229 of the body 320 and directed to flow into a channel 282 of the body 320 and subsequently into a cavity 219 of one or more deflection devices 240. This flow of the drilling fluid 178 through the flow regulator 280 can provide an on-demand, periodic flow of drilling fluid 178 into a cavity 219 of one or more deflection devices 240 to force the deflection devices 240 to move from a normal position to an extended position.

As discussed above, the bottom hole assembly 170, including the rotary bit pushing device 220, rotates around an axis formed by the length of the bottom hole assembly 170 when a field is being developed (e.g., when a wellbore 130 is being drilled to extend the wellbore 130). In order to push the rotary drill bit 232 in the desired direction to extend the wellbore 130, the deflection devices 240 must be extended when the deflection devices 240 are located at a certain point or range of distances along the repeating 360° travel of the deflection devices 240 relative to the wellbore 130.

For example, if a user wants to extend the wellbore 130 in a substantially downward direction, the deflection devices 240 need to be moved into the extended position when the deflection devices 240 are at or near the top of the wellbore 130. In this way, the deflection devices 240, when in the extended position, contact and push against the top of the wellbore 130, which applies a downward force to the remainder of the bottom hole assembly 170, at the end of which is disposed the rotary drill bit 232.

A rotary bit pushing device 220 can have a single line or column of deflection devices 240, where each line or column of deflection devices can have one or multiple deflection devices 240. Alternatively, a rotary bit pushing device 220 can have multiple lines or columns of deflection devices 240, where each line or column of deflection devices can have one or multiple deflection devices 240. For example, as shown in FIGS. 3A-3C, the rotary bit pushing device 220 has three columns of deflection devices 240, and each column has two deflection devices 240.

When the rotary bit pushing device 220 has multiple columns of deflection devices 240, the deflection devices 240 in each column must be controlled independently of the deflection devices 240 in the other columns. Without this independent control of the columns of deflection devices 240, the rotary bit pushing device 220 would push the rotary drill bit 232 in an undesired direction. By contrast, multiple deflection devices 240 within a column can be controlled jointly or independently. If controlled independently, a flow regulator of some type can be incorporated into one or more of the nozzles 265.

Returning to the discussion of the flow regulator 280, as detailed in FIG. 7, the flow regulator 280 can have any of a number of features and/or configurations. For example, as shown in FIGS. 3C and 7, a flow regulator 280 can have multiple inlet ports 285 disposed on face 286 of the flow regulator 280, where each inlet port 285 feeds a separate inlet channel 281, which ties into a channel 282 disposed within the body 320. The inlet ports 285 and inlet channels 281 can help make up a port assembly 386 of the flow regulator 280. The inlet ports 285 of the flow regulator 280 can be part of the same flow regulator 280. Alternatively, each inlet port 285 can be part of an independent flow regulator 280.

Regardless of how many inlet ports 285 the flow regulator 280 has, each inlet port 285 can be independently opened and closed relative to the other inlet ports 285. A local controller 203, embedded within the flow regulator 280, can be used to open and close each of the inlet ports 285. The controller 203 can communicate with the data acquisition system 101 (e.g., the controller 103), using wired and/or wireless (e.g., signals transmitted through the drilling fluid 178) technology. The controller 203 can open and close the various inlet channels 285 in one or more of a number of ways. For example, an inlet port 285 can be closed by closing a valve (not shown) disposed within the inlet channel 281 of that inlet port 285. As another example, the controller 203 can rotate the port assembly 386 at different points along the rotational travel of the rotary bit pushing device 220. In such a case, rotating the port assembly 386 can open or close an inlet port 285, depending on the location of the inlet port 285 relative to an inlet channel 281.

The flow regulator 280 can include one or more sealing devices (not shown) disposed around an outer perimeter of the body 287 and/or body 288. The flow regulator 280 can be integrated with, or a separate component that is mechanically coupled to, the rotary bit pushing device 220. In certain example embodiments, adjacent to the flow regulator 280 can be disposed one or more flow-through channels 284 that traverse a wall (e.g., wall 222) of the body 320. The flow-through channel 284 opens into the cavity 229 that traverses the length of the body 320. This flow-through channel 284 allows a portion of the drilling fluid 178, separate from the drilling fluid that flows through the flow regulator 280, to flow to the flow regulator 610. The flow-through channel 284 can have a valve (not shown) or similar flow regulator disposed therein. Alternatively, the flow-through channel 284 can be unobstructed at all times, allowing a constant flow of drilling fluid 178 to flow therethrough.

Figure 8:
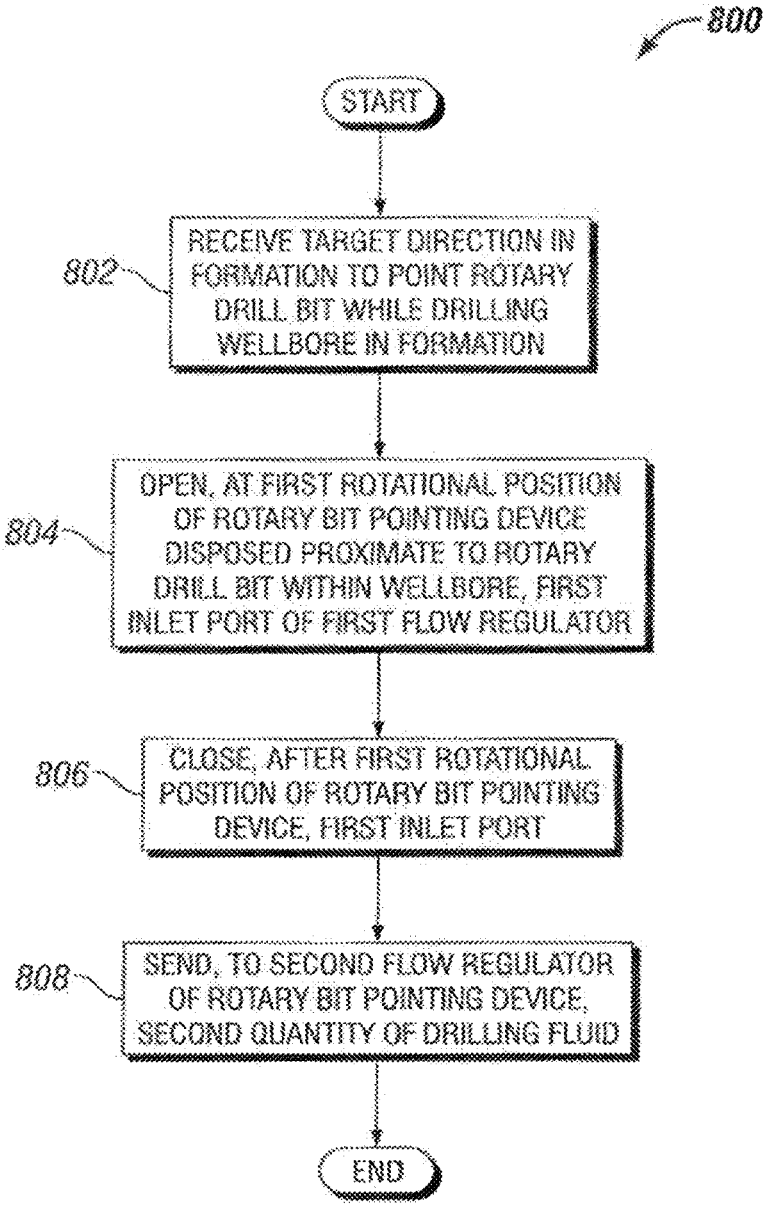
FIG. 8 is a flowchart presenting a method for pushing a rotary drill bit in accordance with one or more example embodiments.

FIG. 8 shows a flowchart of a method 800 for pushing a rotary drill bit in accordance with one or more example embodiments. While the various steps in the flowchart presented herein are described sequentially, one of ordinary skill will appreciate that some or all of the steps may be executed in different orders, may be combined or omitted, and some or all of the steps may be executed in parallel. Further, in one or more of the example embodiments, one or more of the steps described below may be omitted, repeated, and/or performed in a different order. In addition, a person of ordinary skill in the art will appreciate that additional steps may be included in performing the methods described herein. Accordingly, the specific arrangement of steps shown should not be construed as limiting the scope. Further, in one or more example embodiments, a particular computing device, as described, for example, in FIG. 9 below, is used to perform one or more of the method steps described herein.

Referring now to FIGS. 1-8, the example method 800 begins at the START step and continues to step 802, where a target direction in a formation to push the rotary drill bit 232 while drilling a wellbore 130 is received. The target direction is a direction in which a rotary drill bit 232 is pushed within the wellbore 130 while performing a field operation. For example, the field operation can be drilling a wellbore 130 in a subterranean formation 105. In one or more example embodiments, the target direction is a particular radial direction away from the current direction of the wellbore 130. For example, the target direction can be up to a 10° axial deviation, which is the amount of deviation from the directional axis of the bottom hole assembly 170.

The target direction can be received by a controller (e.g., controller 103, controller 203), which can be located, for example, above the surface 104 and/or within the flow regulator 280. The target direction can be sent by a data acquisition system 101 (or portion thereof), which can be located at the surface 104 or at any other location. The target direction can be received by the flow regulator 280 (e.g., the controller 203) using wired and/or wireless technology. For example, pulses can be sent through the drilling fluid in the wellbore 130, received by the flow regulator 280, and translated into readable instructions relative to pushing the drill bit 232.

In step 804, a first inlet port 285 of a first flow regulator 280 is opened. The first inlet port 285 can be opened at a first rotational position of a rotary bit pushing device 220 disposed proximate to the rotary drill bit 232 within the wellbore 130. The first inlet port 285, when in an open position, allows a first quantity of drilling fluid 178 to move a first deflection device 240 (or column of first deflection devices 240) of the rotary bit pushing device 220 from a normal position to an extended position. The first deflection device 240, when in the extended position, contacts the formation bounding the wellbore 130. The first deflection device 240 is among a number of deflection devices 240.

The first rotational position coincides with the target direction at that particular point in time during the field operation. The first rotational position can be a point or an area of rotation relative to the target direction. The first deflection device 240 can be put in the extended position (enabled) by the fluid pressure of the drilling fluid 178 when the drilling fluid 178 fills the cavity 219. For example, if the first deflection device 240 is a piston, pressurizing the cavity 219 of the first deflection device 240 using the drilling fluid 178 enables the first deflection device 240. In certain example embodiments, the first inlet port 285 allows the drilling fluid 178 to flow therethrough based on instructions received from a data acquisition system 101 (or portion thereof, such as a controller 103).

In certain example embodiments, the first inlet port 285 of the first flow regulator 280 is opened using the controller 203 of the first flow regulator 280. Specifically, the controller 203 can rotate the port assembly 386 of the first flow regulator 280 to a certain position to open the first inlet port 285. As another example, the controller 203 can open a valve internal to the port assembly 386, where the valve is in the inlet channel 281 fed by the first inlet port 285. At least a portion of the first quantity of drilling fluid 178 flows through the first deflection device 240 (e.g., through the drainage channel 278) into the wellbore when the first inlet port is in the closed position.

In step 806, the first inlet port 285 is closed. The first inlet port 285 can be closed after the first rotational position of the rotary bit pushing device 240. The first inlet port 285 can be closed by the controller 103 and/or the controller 203 in the same way that the first inlet port 285 was opened in step 604. The first inlet port 285, when in a closed position, stops the first quantity of drilling fluid 178 from flowing to the first deflection device 240 and allows the first deflection device 240 to return to the normal position. As described herein, allowing a deflection device 240 to return to the normal position can also be called disengaging the deflection device 240. By stopping the flow of drilling fluid 178 to the cavity 219 of the deflection device 240, the force keeping the deflection device 240 in the extended position is removed. In certain example embodiments, the first inlet port 285 is closed based on instructions received from a data acquisition system 101 or portion thereof.

In step 808, a second quantity of drilling fluid 178 is sent to a second flow regulator 610 of the rotary bit pushing device 220. The second quantity of drilling fluid 178 can flow through the second flow regulator 610 to the first deflection device 240 when the first inlet port is in the closed position. In addition, the second quantity of drilling fluid 178 can flow through the second flow regulator 610 to the first deflection device 240 when the first inlet port is in the open position. In such a case, the second quantity of drilling fluid 178 can flow through the second flow regulator 610 to the first deflection device 240 at all times, regardless of the position of first inlet port. In this way, drilling fluid 178 will always be flowing through the drainage channel 278 of the deflection device 240, thereby keeping any debris from entering the deflection device 240 and jeopardizing the mechanical integrity of the rotary bit pushing device 220. The second quantity of drilling fluid 178 can flow into the cavity 229 through the flow-through channel 284.

As the rotary bit pushing device 220 rotates with the rest of the bottom hole assembly 170 during a field operation, a second deflection device 240 (or column of second deflection devices 240) can be enabled at a second rotational position when a second inlet port 285 is opened. The second deflection device 240 can be adjacent to the first deflection device 240, on the opposite side of the body 320 from the first deflection device 440, or at some other position relative to the first deflection device 240. Further, the second inlet port 285 can be adjacent to the first inlet port 285, on the opposite side of the flow regulator 280 from the first inlet port 285, or at some other position relative to the first inlet port 285. Similarly, the second rotational position can be adjacent to the first rotational position, on the opposite side of the bottom hole assembly 170 from the first rotational position, or at some other position relative to the first rotational position. In certain example embodiments, the second deflection device can be enabled at substantially the same time as step 606.

The second rotational position coincides with the target direction at that particular point in time during the field operation. The second rotational position can be a point or an area of rotation relative to the target direction. The second inlet port 285 can be opened by the controller 103 and/or the controller 203. In certain example embodiments, the controller 203 opens (and subsequently closes) the second inlet port 285 based on instructions received from a data acquisition system 101. The second deflection device 240 can be enabled in the same or a different manner than the manner in which the first deflection device 240 is enabled.

After the second inlet port 285 is opened, the second inlet port 285 is closed after the second rotational position. Closing the second inlet port 285 disables the second deflection device 240. The second inlet port 285 can be closed using the controller 103 and/or the controller 203. The controller 203 can open the second inlet port 285 actively or passively. In certain example embodiments, the controller 203 closes the second inlet port 285 based on instructions received from a data acquisition system 101.

The steps described above can cover one full revolution of the bottom hole assembly 170 if there are only two deflection devices 240 and/or inlet ports 285. If there are more than two deflection devices 240 and/or inlet ports 285, then each of the additional deflection devices 240 and/or inlet port 285 is similarly enabled/disabled and/or opened/closed when the respective additional deflection device 240 and/or inlet port 285 enters and leaves a rotational position that corresponds to the target position. In certain example embodiments, the bottom hole assembly can rotate up to 200 rpm. If the controller 203 continues to receive instructions from the data acquisition system 101, then steps 804 through 808 of the method 800 are repeated for additional revolutions of the bottom hole assembly 170 until the controller 203 stops receiving such instructions and/or receives different instructions. The example process then proceeds to the END step.

Figure 9:
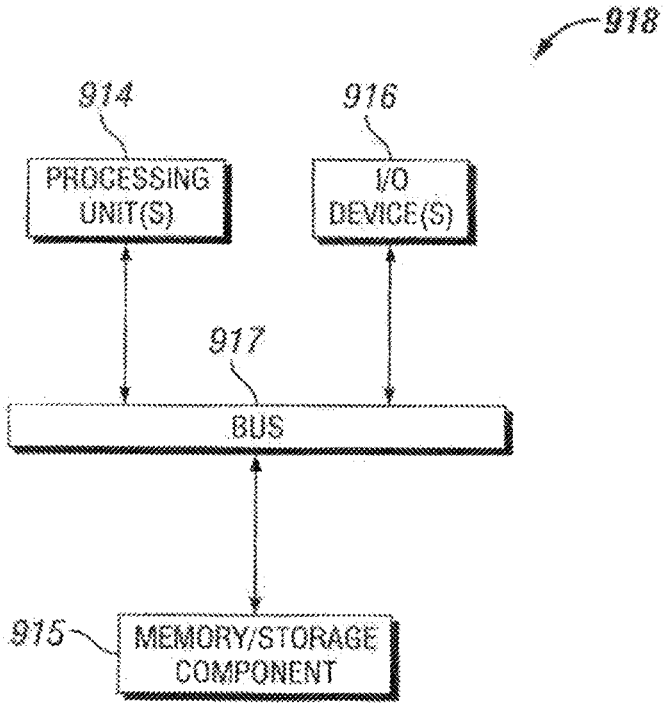
FIG. 9 shows a computer system for implementing pushing a rotary drill bit in accordance with one or more example embodiments.

FIG. 9 illustrates one example of a computing device 918 used to implement one or more of the various techniques described herein, and which may be representative, in whole or in part, of the elements described herein. The computing device 918 is only one example of a computing device and is not intended to suggest any limitation as to scope of use or functionality of the computing device and/or its possible architectures. Neither should the computing device 918 be interpreted as having any dependency or requirement relating to any one or combination of components illustrated in the example computing device 918.

Referring to FIGS. 1-9, the computing device 918 includes one or more processors or processing units 914, one or more memory/storage components 915, one or more input/output (I/O) devices 916, and a bus 917 that allows the various components and devices to communicate with one another. Bus 917 represents one or more of any of several types of bus structures, including a memory bus or memory controller, a peripheral bus, an accelerated graphics port, and a processor or local bus using any of a variety of bus architectures. Bus 917 can include wired and/or wireless buses.

Memory/storage component 915 represents one or more computer storage media. Memory/storage component 915 may include volatile media (such as random access memory (RAM)) and/or nonvolatile media (such as read only memory (ROM), flash memory, optical disks, magnetic disks, and so forth). Memory/storage component 915 can include fixed media (e.g., RAM, ROM, a fixed hard drive, etc.) as well as removable media (e.g., a Flash memory drive, a removable hard drive, an optical disk, and so forth).

One or more I/O devices 916 allow a customer, utility, or other user to enter commands and information to computing device 918, and also allow information to be presented to the customer, utility, or other user and/or other components or devices. Examples of input devices include, but are not limited to, a keyboard, a cursor control device (e.g., a mouse), a microphone, and a scanner. Examples of output devices include, but are not limited to, a display device (e.g., a monitor or projector), speakers, a printer, and a network card.

Various techniques may be described herein in the general context of software or program modules. Generally, software includes routines, programs, objects, components, data structures, and so forth that perform particular tasks or implement particular abstract data types. An implementation of these modules and techniques may be stored on or transmitted across some form of computer readable media. Computer readable media may be any available non-transitory medium or non-transitory media that can be accessed by a computing device. By way of example, and not limitation, computer readable media may comprise "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

The computing device 918 may be connected to a network (not shown) (e.g., a local area network (LAN), a wide area network (WAN) such as the Internet, or any other similar type of network) via a network interface connection (not shown). Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means may take other forms, now known or later developed. Generally speaking, the computing system 918 includes at least the minimal processing, input, and/or output means necessary to practice one or more embodiments.

Further, those skilled in the art will appreciate that one or more elements of the aforementioned computing device 918 may be located at a remote location and connected to the other elements over a network. Further, one or more embodiments may be implemented on a distributed system having a plurality of nodes, where each portion of the implementation (e.g., controller 103, controller 203) may be located on a different node within the distributed system. In one or more embodiments, the node corresponds to a computer system. Alternatively, the node may correspond to a processor with associated physical memory. The node may alternatively correspond to a processor with shared memory and/or resources.

The example embodiments discussed herein provide for pushing a rotary drill bit in a particular direction during a field operation. Specifically, the example embodiments enable and disable various portions of a rotary bit pushing device, positioned between the proximal end of a control shaft and a universal joint. In such a case, the rotary bit pushing device applies a force to the control shaft that remains substantially constant in magnitude and direction relative to the wellbore being drilled, despite the substantially constant rotation of the bottom hole assembly.

When the force is applied to the proximal end of the control shaft, the universal joint causes a substantially equal and opposing force to be applied by the distal end of the control shaft to the bit shaft. This force applied to the bit shaft pushes the bit in the target direction.

Although the invention is described with reference to example embodiments, it should be appreciated by those skilled in the art that various modifications are well within the scope and spirit of this disclosure. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments of the present invention will suggest themselves to practitioners of the art. Therefore, the scope of the present invention is not limited herein.

The invention claimed is:

1. A push the bit rotary steerable system, comprising:

a drill collar comprising a cavity;

a stabilizer coupled to the drill collar and having multiple blades;

a rotary bit pushing device comprising:

a body coupled to the drill collar, the rotary bit pushing device comprising a plurality of deflection devices spaced circumferentially around a longitudinal axis extending through the body, each deflection device being movable between a normal position and an extended position in which the deflection device is farther from the longitudinal axis than when the deflection device is in the normal position, the body comprising a first channel; and a flow regulator coupled to the body and controllable to direct fluid to the first channel through which the fluid can flow toward a first deflection device of the plurality of deflection devices;

wherein:

the flow regulator has a first passage rotatable to a first position in which the first passage is in fluid communication with the first channel; and the first deflection device is movable from the normal position to the extended position after: (i) the first passage has moved to the first position from another position and (ii) the fluid has flowed through the first passage and through the first channel toward the first deflection device.

2. The system of claim 1, the body also comprises a second channel and wherein:

the flow regulator has a second passage rotatable to a position in which the second passage is in fluid communication with the second channel; and the second deflection device is movable from the normal position to the extended position: (i) after the second passage has moved to the second position from another position and (ii) fluid that has flowed through the second passage has also flowed through the second channel toward the second deflection device.

3. The system of claim 1, wherein the drill collar includes a first end that is coupled to the stabilizer via mating threads.

4. The system of claim 1, wherein the drill collar includes a second end that is coupled to the body.

5. The system of claim 1, wherein the flow regulator has a second passage that is not in fluid communication with the first deflection device when the first passage is in the first position.

6. The system of claim 1, wherein each deflection device includes an inner channel and a sealing device in the inner channel.

7. The system of claim 6, wherein each deflection device has an outer surface, at least two recessed areas in the outer surface, and at least two stops, each positioned partially in one of the at least two recessed areas.

8. The system of claim 7, wherein the body has a recess in which a deflection device holder is positioned, the first deflection device being retained in the deflection device holder.

9. The system of claim 8, wherein the deflection device holder includes an opening in which the first deflection device is positioned and at least two deflection device holder recesses, one for each of the at least two stops, one of the at least two stops being positioned partially in one of the at least two deflection device holder recesses and another of the at least two stops being positioned partially in another of the at least two deflection device holder recesses.

10. The system of claim 9, wherein the rotary bit pushing device comprises a first nozzle configured to direct fluid toward the first deflection device such that fluid that exits the first nozzle enters a cavity of the first deflection device.

11. The system of claim 10, wherein the rotary bit pushing device comprises a second flow regulator coupled to the body and in fluid communication with a cavity extending longitudinally through the body, wherein fluid that exits the second flow regulator can flow under a bottom end of the first deflection device.

* * * * *